US007928371B2

(12) United States Patent
Ryjkov

(10) Patent No.: US 7,928,371 B2
(45) Date of Patent: Apr. 19, 2011

(54) METHODS FOR PENNING TRAP MASS SPECTROSCOPY

(76) Inventor: Vladimir Ryjkov, Vancouver (CA)

( * ) Notice: Subject to any disclaimer, the term of this patent is extended or adjusted under 35 U.S.C. 154(b) by 224 days.

(21) Appl. No.: 12/149,544

(22) Filed: May 5, 2008

(65) Prior Publication Data

US 2009/0008544 A1 Jan. 8, 2009

Related U.S. Application Data

(60) Provisional application No. 60/915,874, filed on May 3, 2007.

(51) Int. Cl.
*H01J 49/26* (2006.01)
*H01J 49/36* (2006.01)

(52) U.S. Cl. ..... 250/290; 250/281; 250/282

(58) Field of Classification Search ..... 250/281, 250/282, 290, 291, 292, 293, 297, 298, 299
See application file for complete search history.

(56) References Cited

U.S. PATENT DOCUMENTS

| | | | | |
|---|---|---|---|---|
| 3,937,955 | A | 2/1976 | Comisarow et al. | |
| 4,959,543 | A * | 9/1990 | McIver et al. | 250/291 |
| 4,982,088 | A * | 1/1991 | Weitekamp et al. | 250/291 |
| 5,477,046 | A * | 12/1995 | Dietrich et al. | 250/288 |
| 6,130,426 | A | 10/2000 | Laukien et al. | |
| 6,800,851 | B1 | 10/2004 | Zubarev et al. | |
| 6,803,569 | B2 | 10/2004 | Tsybin et al. | |
| 2006/0232369 | A1 * | 10/2006 | Gorshkov | 335/306 |
| 2008/0302958 | A1 * | 12/2008 | Green | 250/282 |
| 2009/0140140 | A1 * | 6/2009 | Raznikov et al. | 250/287 |
| 2009/0218481 | A1 * | 9/2009 | DeWalch | 250/281 |
| 2009/0278037 | A1 * | 11/2009 | Grothe, Jr. | 250/282 |

OTHER PUBLICATIONS

Gräff, et al., "A Direct Determination of the Proton Electron Mass Ratio," Z. Physik A—Atoms and Nuclei, vol. 297, pp. 35-39 (1980).
König , et al., "Quadrupole Excitation of Stored Ion Motion at the True Cyclotron Frequency," International Journal of Mass Spectrometry and Ion Processes, vol. 142, pp. 95-116 (1995).
Cornell, et al., Single-Ion Cyclotron Resonance Measurement of $M(CO^+)/M(N_2^+)$, Physical Review Letters, vol. 63, No. 16, pp. 1674-1677, (1989).
Cornell, et al., "Mode Coupling in a Penning Trap: π Pulses and a Classical Avoided Crossing," Physical Review A, vol. 41, No. 1, pp. 312-315 (1990).
Rainville, et al., "An Ion Balance for Ultra-High-Precision Atomic Mass Measurements," Science, vol. 303, pp. 334-338 (2004).
Brown, et al., "Geonium Theory: Physics of a Single Electron or Ion in a Penning Trap," Reviews of Modern Physics, vol. 58, No. 1, pp. 233-311 (1986).
Guan, et al., "Ion Traps for Fourier Transform Ion Cyclotron Resonance Mass Spectrometry: Principles and Design of Geometric and Electric Configurations," International Journal of Mass Spectrometry and Ion Processes, vol. 146/147, pp. 261-296 (1995).
Marshall, et al., "Fourier Transform Ion Cyclotron Resonance Mass Spectrometry: A Primer," Mass Spectrometry Reviews, vol. 17, pp. 1-35 (1998).
Written Opinion, Aug. 18, 2008 (copending Intl. Appl. No. PCT/CA2008/000859).
International Search Report, Aug. 18, 2008 (copending Intl. Appl. No. PCT/CA2008/000859).

* cited by examiner

*Primary Examiner* — Robert Kim
*Assistant Examiner* — Nicole Ippolito Rausch

(57) ABSTRACT

A method of mass spectroscopy according to example embodiments may include injecting ions into a Penning trap and exciting the ions into cyclotron and/or magnetron motions. The cyclotron motions and magnetron motions may be converted to one another with external radio frequency signals. The ions may be ejected from the Penning trap onto a position sensitive charged particle detector to determine the phases and amplitudes of the motions. Ion cyclotron resonance frequencies may be determined based on the phases and amplitudes of the motions of the ejected ions.

26 Claims, 19 Drawing Sheets

METHODS FOR PENNING TRAP MASS SPECTROSCOPY

PRIORITY STATEMENT

This application claims benefit under 35 U.S.C. §119(e) to U.S. Provisional Application No. 60/915,874, filed on May 3, 2007 in the United States Patent and Trademark Office, the disclosure of which is incorporated herein in its entirety by reference.

BACKGROUND

1. Technical Field

Example embodiments relate to methods for performing ion trap mass spectroscopy.

2. Description of Related Art

Penning trap mass spectrometry is a widely-used mass spectrometry method in terms of resolution and precision. Consequently, the precision of the method renders it suitable for some of the more demanding experiments being conducted in fundamental physics. In addition, the high resolving power of Penning trap mass spectrometry makes it a valuable tool in many chemical and biological applications.

Ion motion within a Penning trap is discussed in a number of references readily available to those ordinarily skilled in the art. In general, charged particles are confined in a Penning trap as the result of a combination of a homogeneous magnetic field and a static quadrupole electric field. In discussing Penning traps, the coordinate system is typically chosen so that the magnetic field is directed along the z-axis:

$$\vec{B}=B_0\vec{k}=\{0,0,B_0\}, \tag{1}$$

wherein $B_0$ is the strength of the magnetic field. The magnetic field tends to confine the particles in the direction perpendicular to the direction of the magnetic field, thereby forcing the particles into generally circular orbits around the magnetic field lines. The circular orbits may be referred to as the cyclotron motion of the particles. To confine the charged particles in the direction along the magnetic field, a quadrupole electrostatic field is provided in conjunction with the magnetic field:

$$\vec{E}=\vec{\nabla}V(x,y,z), \tag{2}$$

$$V(x,y,z)=\frac{V_0}{2d^2}\left(z^2-\frac{x^2+y^2}{2}\right)=\frac{V_0}{2d^2}\left(z^2-\frac{r^2}{2}\right), \tag{3}$$

where d is the characteristic trap size and $V_0$ is the magnitude of the trapping potential. The electric field creates a harmonic potential well along the z-axis, and the motion of the trapped particle is that of a harmonic oscillator:

$$z(t)=A_z\cos(\omega_z t+\phi_z), \tag{4}$$

where $A_z$ is the amplitude of the axial oscillatory motion, $\omega_z=\sqrt{qV_0/mr_0^2}$ is the angular frequency of the axial oscillatory motion, and $\phi_z$ is the phase of the axial oscillatory motion.

FIG. 1 is an illustration of a conventional Penning trap mass spectroscopy device. Referring to FIG. 1, a conventional Penning trap mass spectroscopy device includes a magnet 1 that creates a uniform (homogeneous) magnetic field. An ion cyclotron resonance (ICR) cell 3 is placed inside a vacuum chamber that is connected to and evacuated using a suitable vacuum system 2. Generally, the ICR cell 3 is positioned so that it will be exposed to the strong homogeneous magnetic field produced by the magnet 1. Such a position is typically near the center of the volume surrounded by the magnet 1.

The ion motion in the direction perpendicular to the magnetic field direction (radial motion) is a combination of two circular motions: the fast modified cyclotron motion and the slow magnetron motion. The ion motion is described by the following expression:

$$x(t)+iy(t)=\tilde{A}_+e^{i\omega_+t}+\tilde{A}_-e^{i\omega_-t}, \tag{5}$$

where $\tilde{A}_+=A_+e^{i\phi_+}$ is a complex constant that incorporates the amplitude and phase of the modified cyclotron motion and $\tilde{A}_-=A_-e^{i\phi_-}$ is a complex constant that incorporates the amplitude and phase of the magnetron motion. The angular frequencies of the magnetron motion and the modified cyclotron motion are respectively given by the following expressions:

$$\omega_-=\frac{1}{2}\left(\omega_c-\sqrt{\omega_c^2-2\omega_z^2}\right)=\frac{\omega_z^2}{2\omega_+}, \tag{6}$$

$$\omega_+=\frac{1}{2}\left(\omega_c+\sqrt{\omega_c^2-2\omega_z^2}\right)=\omega_c-\omega_-, \tag{7}$$

where $\omega_c=qB_0/m$ is the angular frequency of the cyclotron motion of a particle in the magnetic field in the absence of a quadrupole electric field. The stability conditions for the trapped charged particle in the Penning trap dictate that $$\omega_-<\omega_z<\omega_+. \tag{8}$$

Fourier transform ion cyclotron resonance (FT-ICR) is the most widely-used method of Penning trap-based mass spectroscopy. A conventional FT-ICR method involves exciting the modified cyclotron motion of an ion "packet" placed into a Penning trap and then detecting the modified cyclotron motion by measuring the current it induces on the segmented electrodes of the Penning trap. The frequency components of the detected signal correspond to ions with different mass-to-charge ratios in the ion "packet." This information is typically extracted from the detected signal by performing a fast Fourier transform (FFT) analysis on the digitized signal.

FIG. 2 is an illustration of a conventional FT-ICR method. FIG. 2*a* shows a simplified circuit for the excitation of the ion packet. FIG. 2*b* shows a simplified circuit for the detection of the ion packet. FIG. 2*c* shows a mock-up example of a stored waveform inverse Fourier transform (SWIFT) excitation waveform and its spectrum. FIG. 2*d* shows an example of a detected ICR signal and its spectrum for a mixture of 3 different ion species with cyclotron frequency values f=150, 500, and 510. Referring to FIGS. 2*c-d*, typically $T_{rf}<<T_{acq}$.

The resolving power of the conventional FT-ICR method is determined by the acquisition time of the induced current ICR signal, which takes up the majority of the measurement cycle $T_{meas}\approx T_{acq}$:

$$R_{FTICR}\approx\nu_c T_{meas}; \tag{9}$$

where $\nu_c=\omega_c/2\pi$ is the cyclotron frequency and $T_{meas}$ is the duration of the measurement cycle. The sensitivity of the conventional FT-ICR method is typically about 100 ions.

Time of flight ion cyclotron resonance (TOF-ICR) mass spectrometry is used in precision mass spectrometry and is typically performed on a single ion. Conventional TOF-ICR mass spectrometry can achieve precision on the order of $\delta m/m<1$ ppb. To determine the ion mass, the ion's magnetron motion is induced by dipole excitation at the magnetron frequency or by injecting the ion into the trap off-axis. The magnetron motion is then converted to the cyclotron motion by applying a quadrupole radio frequency (RF) field at a frequency close to the sum frequency $\omega_{rf}\approx\omega_+ + \omega_- = \omega_c$:

$$\vec{E} = (x\hat{y} - y\hat{x})\frac{V_{rf}}{2a^2}\cos(\omega_{rf}t + \phi_{rf}) \tag{10}$$

The conversion is the most efficient when the frequency of the quadrupole signal coincides with the ion's cyclotron frequency. The conversion efficiency is determined by expelling the ion from the trap and then measuring its time of flight to a detector placed outside the strong magnetic field. As the ion exits the magnetic field, it passes the region of strong magnetic field gradient, which accelerates the ion to a degree proportional to its magnetic moment:

$$\vec{F} = -\vec{\nabla}\vec{\mu}\vec{B}, \tag{11}$$

where $\mu \propto A_+$. The time of flight measurement is performed for a set of frequencies in the neighborhood of the ion cyclotron frequency $\omega_c$.

FIG. 3 is an illustration of the results of a conventional time of flight measurement. FIG. 3*a* shows the radial energy and the time of flight for a typical mass measurement as a function of the detuning of the quadrupole RF signal from the ion's cyclotron frequency $\omega_c$. Three characteristic points of the spectrum are identified on the graph: A, B, and C. At point A, the quadrupole RF signal is on resonance, and the time of flight is the shortest. At point B, the quadrupole RF signal is off resonance. At point C, the quadrupole RF signal is at the "satellite" resonance that appears due to the sin x/x spectrum of the square envelope of the RF signal. FIG. 3*b* shows ion trajectories at the beginning of the quadrupole RF excitation, in the middle, and at the end for each of points A, B, and C.

The resolving power of a conventional time of flight measurement is determined by the spectral line-width of the RF quadrupole excitation, i.e., its duration $T_{rf}$. Because the majority of the measurement cycle is used for the RF excitation $T_{meas}\approx T_{rf}$, $$R_{TOF}\approx\nu_c T_{meas}; \tag{12}$$

where $T_{rf}$ is the time interval during which the quadrupole excitation signal was applied, which is essentially the measurement time. With careful reduction of systematic effects, curve-fitting the resulting time-of-flight data can determine the mass with a precision of $\delta m/m\approx 1/R\ 1/\sqrt{N}$. The statistical factor $1/\sqrt{N}$ comes from repeating the TOF measurement N times.

Because the TOF-ICR method is not used for determining the composition of the ion mixture in the trap, but rather for determining the mass of a single ion with high precision, it is more appropriate to define the efficiency of the method rather than its sensitivity. Typically, a microchannel plate (MCP) stack is used for this purpose, with the most common detection efficiency being ≈50%.

An axial phase detection method utilizes features from both the FT-ICR and TOF-ICR methods. In a conventional axial phase detection method, an ion is initially excited into cyclotron motion and allowed to orbit around the trap center for a given period of time. At the end of that period of time, the cyclotron motion is converted to axial oscillation by applying a quadrupole RF field. This conversion is substantially identical to the magnetron-cyclotron conversion used in the TOF-ICR method. However, instead of coupling the magnetron and cyclotron motions, the cyclotron motion is coupled to the axial motion by means of quadrupole RF signal $$\vec{E} = (x\hat{z} - z\hat{x})\frac{V_{rf}}{2a^2}\cos(\omega_{rf}t + \phi_{rf}) \tag{13}$$

at the frequency $\omega_{rf}$ tuned to the resonant coupling frequency $\omega_+ - \omega_z$.

The axial motion of the ion is then detected by measuring the current induced by ion motion in the trap electrodes, in a manner similar to that utilized in FT-ICR detection methods. Both frequency and the phase of the axial motion are determined from the detected signal. Because the current induced by a single ion is very small, a very sensitive superconducting quantum interference device (SQUID)-based superconducting resonant circuitry is used to detect the axial motion. The additional phase information allows to achieve higher resolving power than $\nu_c T_{meas}$, typical for any method that is not sensitive to the phase of the ion motion. The resolving power is instead $$R \approx \left(\frac{2\pi}{\Delta\phi}\right)\times \nu_c T_{meas}, \tag{14}$$

where $\Delta\phi$ is the uncertainty of the phase measurement. The benefit of the enhancement factor $2\pi/\Delta\phi$ is reduced if the acquisition time of the axial motion detector is not insignificant when compared to the total time of the measurement. The detection of the accumulated phase using the SQUID detection of the axial motion typically allows determining the phase with precision $\Delta\phi=15°$ which corresponds to the enhancement factor of 24. The detection time of the axial motion is 4-8 seconds.

Like the TOF-ICR method, axial phase detection measurements are performed on a single ion or a pair of different ions for ultra-precise determination of their mass ratio. Thus, neither the axial phase detection ICR method nor the TOF-ICR method is particularly suitable for analyzing ion mixture compositions. Accordingly, despite the enhanced sensitivity offered by the TOF-ICR method and the resolution enhancement offered by the axial phase detection method, these methods do not rise to the same level as FT-ICR methods in the area of determining ion mixture composition.

SUMMARY

Example embodiments of the present application relate to methods for Penning trap mass spectroscopy. A method of mass spectroscopy according to example embodiments may include injecting ions into a Penning trap and exciting the ions into a cyclotron or a magnetron motion. The ions may be allowed to perform the cyclotron motion or magnetron motion, and such motions may be converted back and forth by means of radio frequency signals. The amplitudes and phases of the motions may be manipulated by means of additional radio frequency signals. Upon completion of the manipulation period, the ions may be ejected from the Penning trap onto a position sensitive charged particle detector to determine phases and amplitudes of their motion. Ion cyclotron resonance frequencies of the ions may be determined based on this information.

The ions may have different mass ranges, and one or more different external radio frequency signals may be used to achieve different motion radii for different mass ranges of the ions. The motion radii may be increased in steps from one mass range to another mass range. Alternatively, the motion radii may be gradually increased from one mass range to another mass range. Additionally, the ions of one mass range may be ejected at a different time from ions of another mass range. The ions may be ejected by axial excitation.

The position sensitive charged particle detector may be a segmented detector. Alternatively, the position sensitive charged particle detector may be a microchannel plate detector with electronic or optical readout or another suitable position sensitive charged particle detector. Additionally, one or more apertures may be placed so as to be in the path of the ejected ions. The position sensitive charged particle detector may be placed in an intermediate region between an internal region inside a magnetic field of the Penning trap and an external region outside the magnetic field of the Penning trap. The phase(s) and amplitude(s) of the motion may be determined based on an area(s) of the position sensitive charged particle detector receiving the ejected ions.

DETAILED DESCRIPTION OF EXAMPLE EMBODIMENTS

Figure 1:
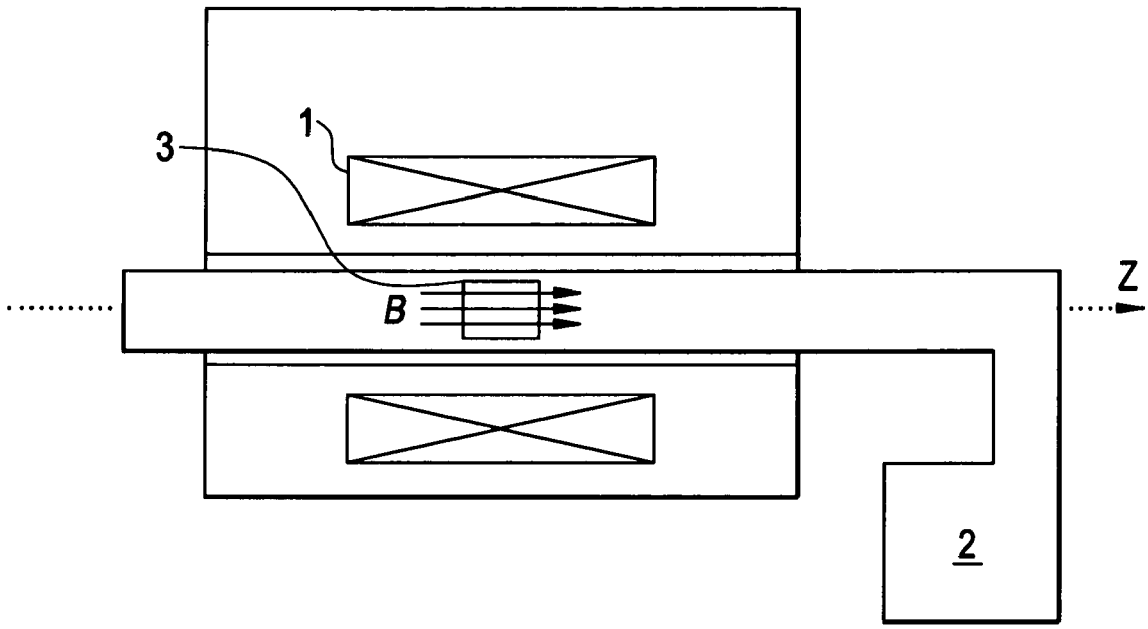
FIG. 1 CONVENTIONAL ART
FIG. 1 is an illustration of a conventional Penning trap mass spectroscopy device.
Figure 2A:
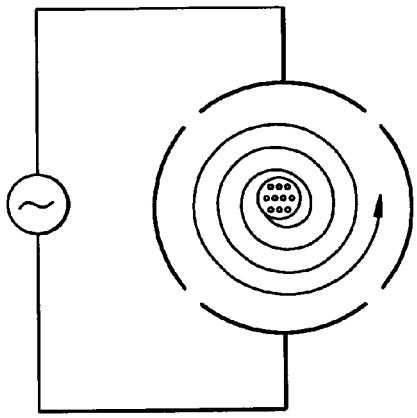
FIG. 2A CONVENTIONAL ART
FIG. 2 is an illustration of a conventional Fourier transform ion cyclotron resonance (FT-ICR) method.
Figure 2B:
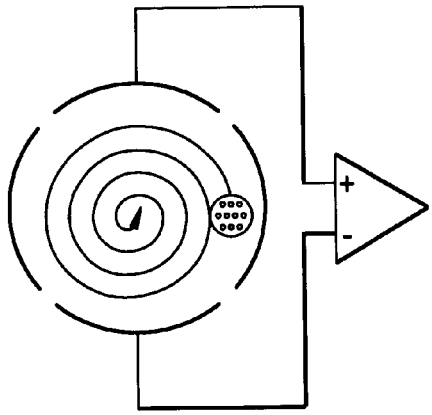
FIG. 2B CONVENTIONAL ART
Figure 2C:
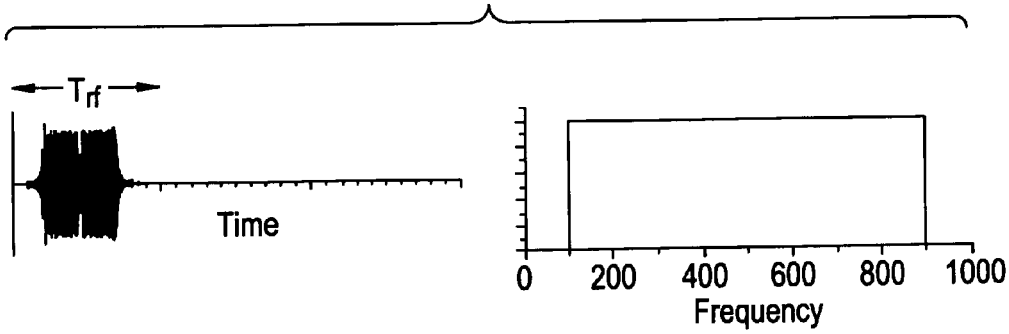
FIG. 2C CONVENTIONAL ART
Figure 2D:
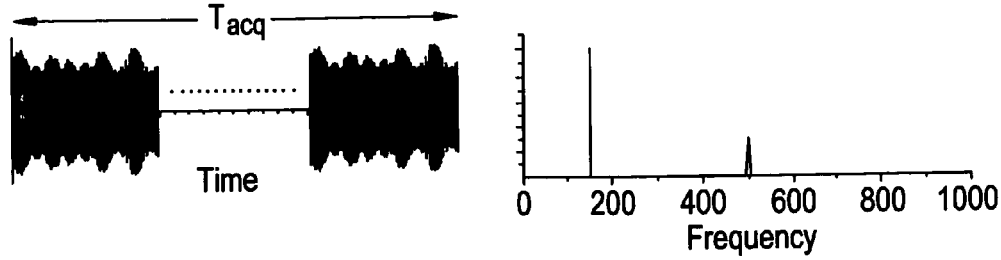
FIG. 2D CONVENTIONAL ART
Figure 3A:
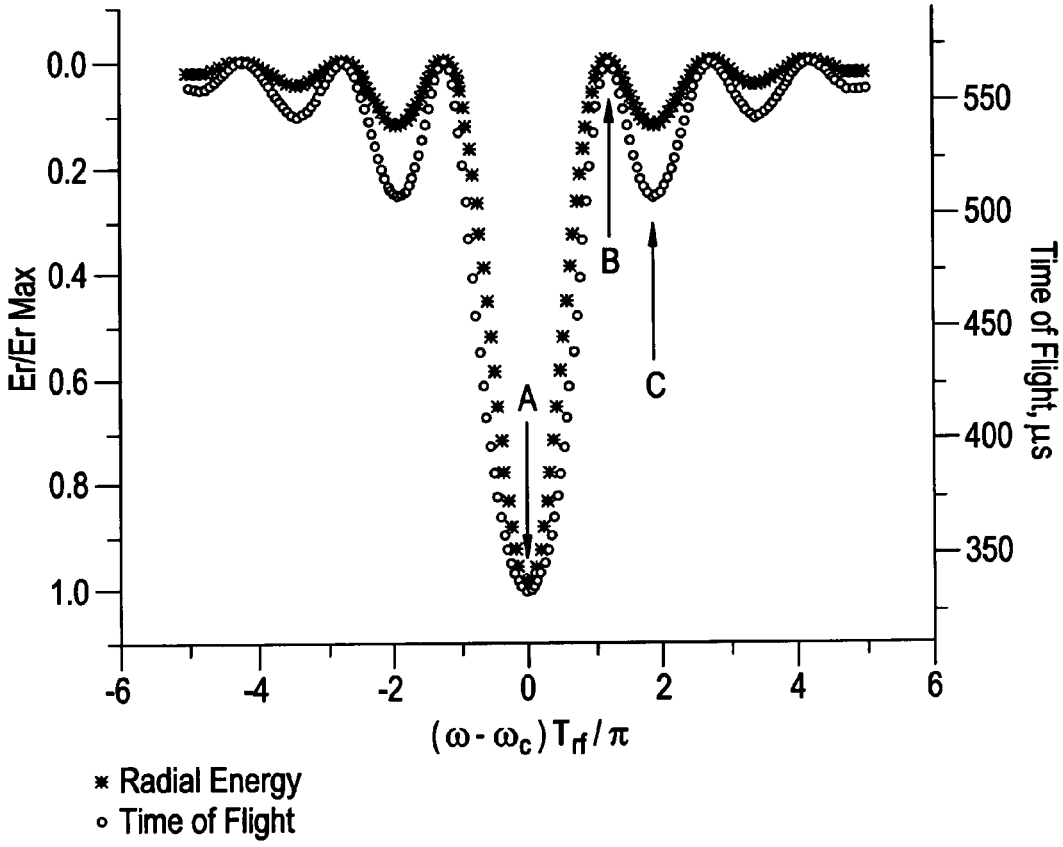
FIG. 3A CONVENTIONAL ART
FIG. 3 is an illustration of the results of a conventional time of flight measurement.
Figure 3B:
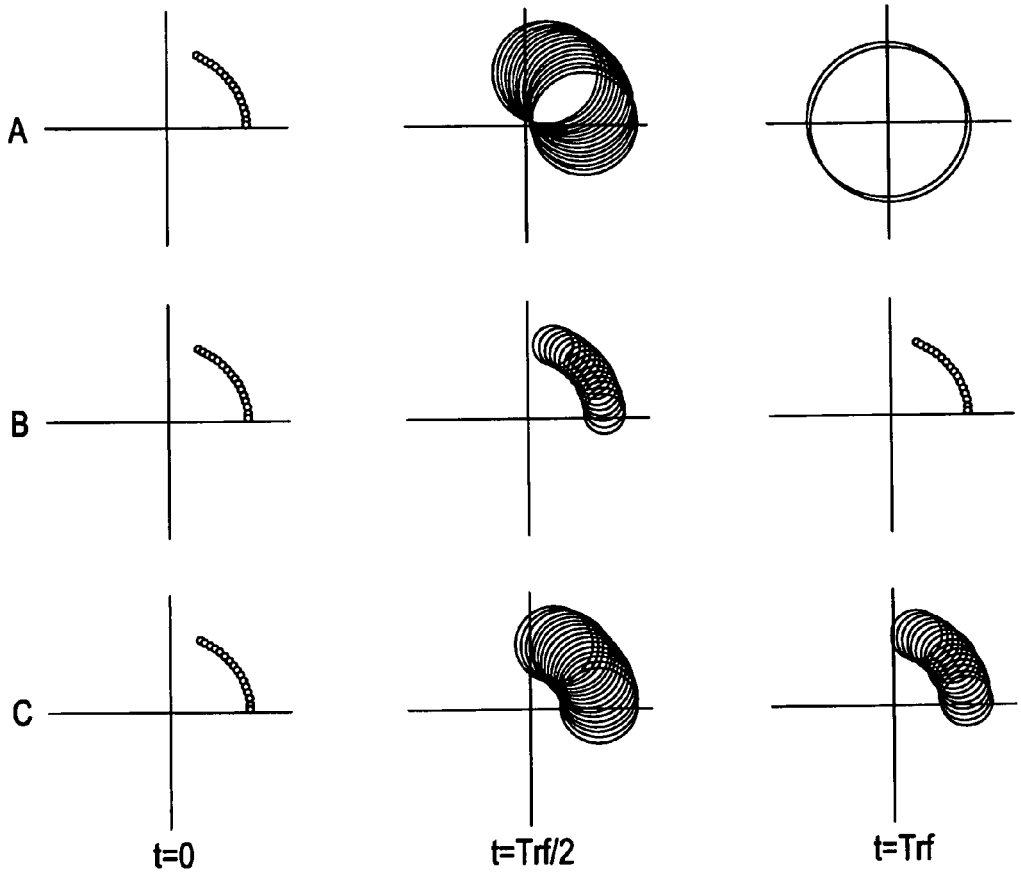
FIG. 3B CONVENTIONAL ART

It will be understood that when an element or layer is referred to as being "on", "connected to", "coupled to", or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It will be understood that, although the terms first, second, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example embodiments.

Spatially relative terms, e.g., "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments of the present application relate to methods of Penning trap mass spectrometry. For example, the methods according to example embodiments may utilize magnetron phase ion cyclotron resonance (MP-ICR) to achieve phase sensitivity and, as a result, improved mass resolution of the spectrometry for the same measurement time compared to conventional FT-ICR methods. MP-ICR mass analysis may be performed by determining the amplitude and phase information of either a magnetron motion or a cyclotron motion. Throughout this document, the mass measurement method may be referred to as "MP-ICR" regardless of whether amplitudes and phases of magnetron or cyclotron motion of the ions are used.

It may be more difficult to determine the phase of the cyclotron motion. Cyclotron motion is relatively fast and if an ion is ejected towards the detector while undergoing cyclotron motion, the ion trajectory and contact site on the detector may be affected by the time it takes for the ion to reach the detector. On the other hand, the amplitude and phase of the magnetron motion may be less affected by the ejection of the ion. Thus, converting cyclotron motion to magnetron motion may help preserve the pertinent phase and amplitude information. Consequently, the amplitude and phase of the magnetron motion may be used to determine the amplitude and the phase of the cyclotron motion before the conversion.

The resolution enhancement due to phase determination may be illustrated as follows. A conventional method (e.g., FT-ICR) can only distinguish between two masses if, during the measurement time, the cyclotron motion of one of the masses have completed at least one full revolution more (or less) than the other. For instance, a conventional FT-ICR method may be able to separate two components if one component of the ion packet has completed 15¼ revolutions and the other component has completed 16½ revolutions. However, the conventional FT-ICR method will not be able to distinguish between components if one has completed 15¼ revolutions and the other has completed 15½ revolutions.

In contrast, the methods according to example embodiments are based on determining what fraction of the revolution a particular ion packet component has completed during the measurement time, thus increasing the resolution. With only phase information, components of an ion packet that have the same phase, but have completed different number of revolutions (e.g., 15½ and 16½), cannot be distinguished. This limits the range of masses that may be determined in a single measurement. Ways to overcome this limitation are described below.

Superconducting solenoidal electromagnets are often used to construct conventional Penning trap mass spectrometers. However, those ordinarily skilled in the art will appreciate that alternative structures and methods may be utilized for producing a sufficiently uniform magnetic field for purposes of example embodiments herein. For example, alternative structures and methods may include non-superconducting electromagnets and/or permanent magnets.

Those ordinarily skilled in the art will also appreciate that additional devices and mechanisms may be associated with the conventional Penning trap mass spectrometer of FIG. 1 to generate and transport charged particles into the ICR cell according to example embodiments herein. A variety of suitable methods for generating and transporting charged particles are known to those ordinarily skilled in the art. It should be understood that suitable methods, mechanisms, and devices need not be those specific to Penning trap-based mass spectrometry. Examples of suitable charged particle sources include, but are not limited to, electrospray ionization (ESI), matrix assisted laser desorption (MALDI), electron beam ionization, and surface ionization. Furthermore, those ordinarily skilled in the art will appreciate that a Penning trap mass spectrometer may also include a variety of detectors and associated electronics depending on the desired ICR method, which may include the MP-ICR method according to example embodiments.

With the MP-ICR method according to example embodiments, the ICR frequency information may be reflected in the phase of the magnetron motion as discussed in more detail below. After manipulation, the ions may be ejected from the Penning trap with their ejection trajectories depending on the phase of the circular motion at the time of ejection. Accordingly, when the ejected ions strike and are registered by an associated position sensitive particle detector, the corresponding phase information may be deduced from the ion contact data. Particle detection methods exhibiting efficiencies approaching a single particle sensitivity level may be used, thereby providing a MP-ICR mass spectrometry with enhanced sensitivity relative to conventional broadband FT-ICR methods.

To detect the amplitude and phase of the magnetron motion, the ions may be ejected from the trapping region along the magnetic field direction. When extracted, the ions may travel along the magnetic field lines in the homogeneous magnetic field region. Within the homogeneous region, the magnetic field lines may be relatively parallel to one another. Outside the homogeneous region, the magnetic field lines may begin to diverge, with only the central field line remaining relatively straight. Consequently, as the ions travel through the magnetic field gradient to outside the relatively strong magnetic field, they may receive a radial momentum kick associated with the canonical momentum conservation. The gain of the radial momentum may be proportional to the distance of the ion to this central field line when the ion was inside the homogeneous field region. The radial momentum kick may be gradual and may result in a slight spiral-like bend of the ion trajectories.

Figure 4:
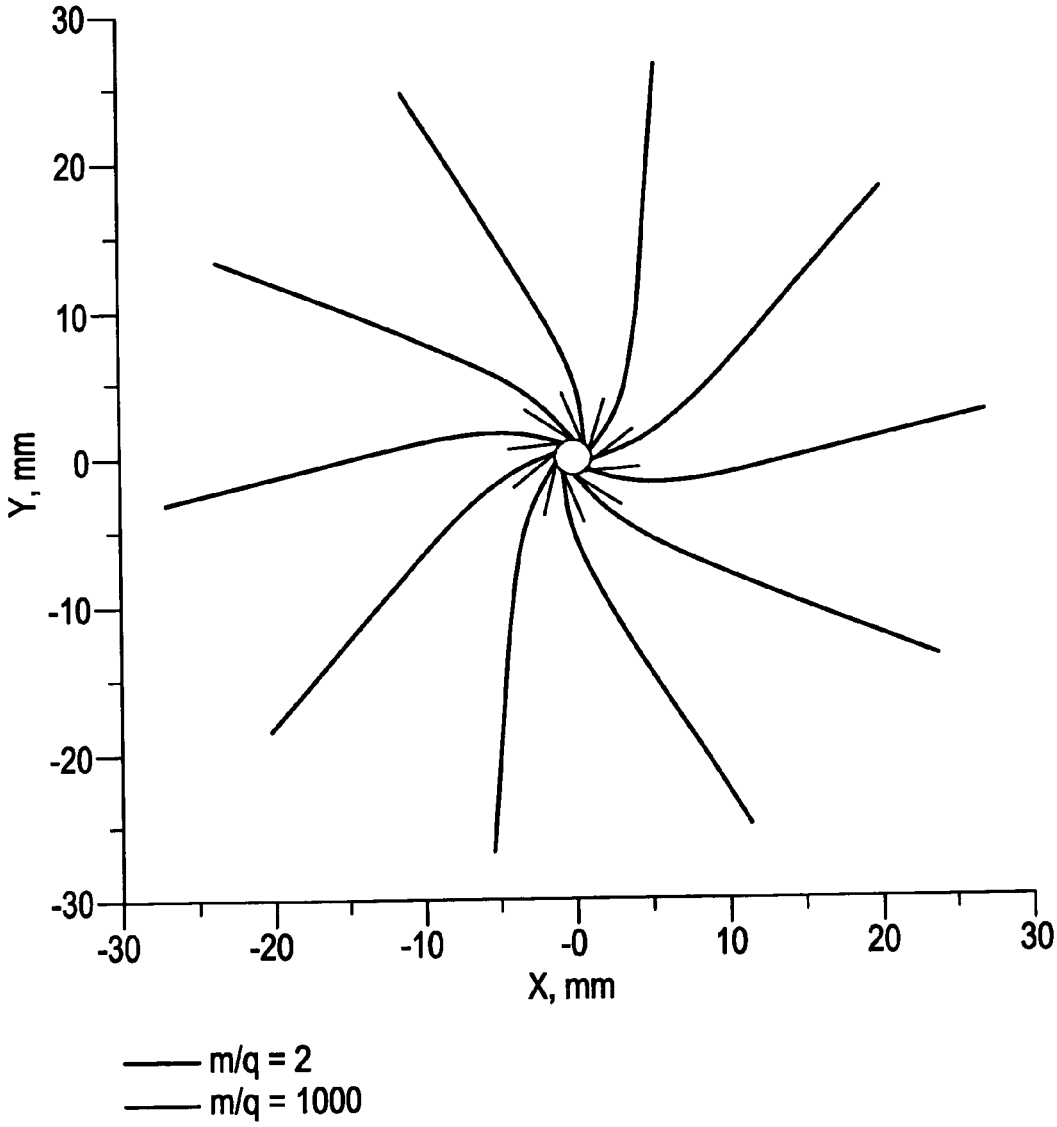
FIG. 4 is an illustration of ion trajectories after extraction according to example embodiments.

FIG. 4 shows trajectories for ions with m/q=2 and m/q=1000 after extraction from a relatively strong magnetic field region. The ions may be extracted from a mock unshielded 4T solenoid field with an extraction energy of about 1 keV. Inside the magnetic field, the ions may be placed on a circle of about 1 mm radius, with equal angular spacing, to simulate the extraction of ions with different phases of magnetron motion. The ion trajectories may terminate outside the strong magnetic field at about the same distance from the magnet center.

As shown in FIG. 4, because of the cylindrical symmetry of the magnetic field, the impact points of the ions may be equally spaced along circles at all stages of the extraction. One of the effects of the extraction is that ions with different m/q ratios may have different divergences after passing through the gradient region of the magnetic field. This results in the ion impact points having different radii for ions with different m/q ratios. Thus, the extraction may introduce a relatively crude mass selection. The more important aspect for mass determination is the fact that the extraction may preserve the information about the phase of the magnetron motion (angular position along the magnetron motion circle). With additional radio frequency (RF) manipulation, the mass information of the ions may be reflected in the phase of the magnetron motion, as described in further detail below.

The information about the radius and the phase of the magnetron motion may be obtained if the impact locations of the ions extracted from the Penning trap are recorded. Recordation may be accomplished with position sensitive charged particle detectors. Examples of suitable position sensitive charged particle detectors may include aperture(s) and segmented detectors. All of the detectors are position sensitive to the degree that they do not detect particles that fall outside their detection area. While the detection area may be relatively large (e.g., from few mm to several cm), the position discrimination may be further improved by employing an aperture or a plurality of apertures. It is also possible to use the method in a pass through (mass filter) mode, wherein the particles may be ejected from the Penning trap pass through the aperture(s), thereby allowing for mass selection.

Examples of suitable position sensitive charged particle detectors may also include microchannel plate (MCP) imagers with optical image readouts. An MCP based particle detector may be rendered position sensitive by using a phosphor screen as an anode. The incoming particles may generate an optical image on the screen, wherein the image may be read out optically. For instance, the image may be read using a charge-coupled device (CCD) camera. Position sensitive detectors of this type may be particularly suitable for imaging particles arriving at relatively high rates.

Examples of suitable position sensitive charged particle detectors may further include single particle position sensitive devices. Various schemes may be available for achieving position sensitivity on a per particle basis. The position and time of arrival of each particle may be determined by either charge division (e.g., resistive, wedge, and strip anodes) or propagation delay (e.g., wire anode) readout.

Figure 5:
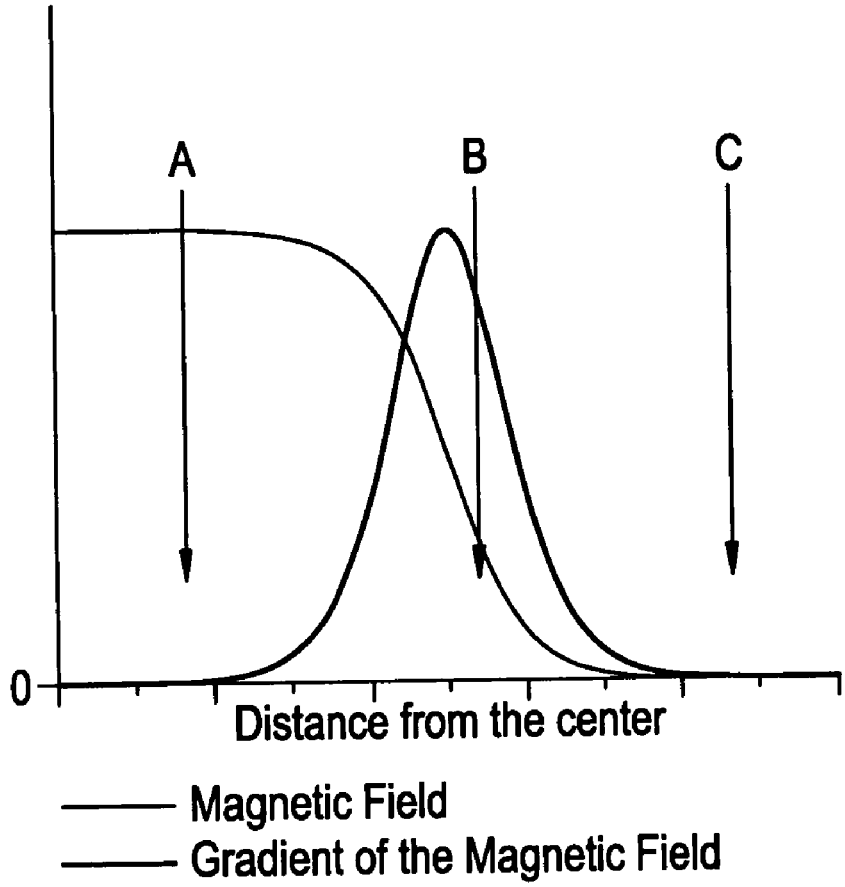
FIG. 5 is an illustration of the possible locations for a position sensitive particle detector according to example embodiments.

FIG. 5 is an illustration of the possible locations for a position sensitive particle detector according to example embodiments. Referring to FIG. 5, the position sensitive particle detector may be placed in different locations relative to the homogeneous magnetic field region, as indicated by locations A, B, and C. A superconducting solenoid is also schematically shown in the background of FIG. 5, although example embodiments are not limited thereto, to illustrate the various regions for placing the position sensitive particle detector.

Regarding location A, the position sensitive particle detector may be placed inside the homogeneous magnetic field. Inside the relatively strong magnetic field region, the ions have not yet received the radial "kick". Consequently, the ion radial position may remain approximately the same as it was prior to extraction. The advantage with this placement is that there may be less of a chance of distorting the image. On the other hand, the disadvantage with this placement is that ion detectors may not be easy to operate in a relatively strong magnetic field. For instance, the image size may be relatively small and, thus, difficult to resolve.

Regarding location C, the position sensitive particle detector may be placed outside the homogeneous magnetic field. In this outside region, the ions may have received the additional radial momentum so as to spiral out away from the center field line. The absence of a relatively strong magnetic field and the availability of a larger image size may make it easier to obtain and resolve the image. However, the image may be distorted if the Penning trap is not centered around the center field line. The image may also be affected by distortions of the gradient magnetic field and extraction optics.

Regarding location B, the position sensitive particle detector may be placed in the intermediate region between the area inside the magnetic field and the area outside the magnetic field. In the intermediate region, the influence of the field gradient "kick" may have a lesser effect on the image. Consequently, the distortions due to misalignment may be smaller. Furthermore, the imaging in this region may be easier as a result of the smaller magnetic field.

An ion in a Penning trap has three characteristic motions: a cyclotron motion, a magnetron motion, and an axial motion. One characteristic motion may be converted to another characteristic motion with a quadrupole RF field. Examples of such conversions may be found in E. A. Cornell, et al., "Mode coupling in a penning trap: π pulses and a classical avoided crossing," *Phys. Rev. A* 41 (1), pp. 312-315, 1990 ("Cornell II"), the entire contents of which are incorporated herein by reference.

A conversion exchanges the actions and phases of the two motions and may be used to reflect phase sensitive ICR information in the phase of the magnetron motion. A variety of external RF excitation may be used to manipulate the amplitude and the phase of the ion motion. Two such methods are detailed below, although example embodiments are not limited thereto. It is understood that an ion in a Penning trap will always have the three characteristic oscillatory motions described above, with different amplitudes and phases associated with each motion. For instance, an ion that is in a magnetron state will still have a cyclotron component to it, although the cyclotron component may be relatively small compared to the magnetron motion. Thus, "pure" cyclotron and/or magnetron motions are only idealized states. For purposes of the method according to example embodiments, although it may be sufficient for the ions to be in a generally magnetron state prior to ejection, it may be beneficial for the ions to be as close to the "pure" magnetron state as possible prior to ejection from the trap.

A first example method of obtaining the ICR frequency information may involve MP-ICR via free cyclotron motion phase accumulation. In such a method, an ion may be allowed to perform almost a pure cyclotron motion circling the trap axis. The cyclotron motion may be achieved in various ways. For instance, an ion packet may be initially provided so as to circle the trap axis in a pure magnetron motion, wherein the magnetron motion may be accomplished by brief magnetron excitation or injecting the ion packet off-axis into the ICR cell. The pure magnetron motion may then be converted to a pure cyclotron motion by an external RF signal. Alternatively, the ion packet may be injected on-axis into the ICR cell and subsequently excited by an external RF signal to achieve a cyclotron motion.

After giving the ion a certain time interval to perform the cyclotron motion for purposes of cyclotron phase accumulation, an external RF signal may be applied to convert the cyclotron motion into a magnetron motion. The phase of the resulting magnetron motion will be:

$$\phi_{-}=\omega_{+}\Delta t+\delta\phi, \tag{15}$$

where $\Delta t=T_{meas}$ is the measurement time, $\phi$ is the magnetron phase, $\omega_{+}$ is the modified cyclotron frequency of the ion (which is the quantity of interest), and $\delta\phi$ is the change in phase due to the conversion. This last quantity is the calibration offset that needs to be determined. This method allows the determination of the modified cyclotron frequency $\omega_{+}$. The resolving power of this phase sensitive method may be described by expression 14, supra.

This method makes it easier to use dipole cyclotron excitation to prepare the ions. Consequently, the phase and the amplitude of the ion mixture may be manipulated in a mass-dependent way, similar to FT-ICR excitation. Manipulating the final magnetron motion radius may enhance the dynamic range of the MP-ICR method according to example embodiments.

It is also possible to obtain the cyclotron phase information by immediately extracting the ions following the period of the cyclotron phase accumulation, thus omitting the conversion of the cyclotron motion into the magnetron motion. However, this approach somewhat simplifies the measurement procedure at a cost of potentially degrading the performance. If the ions are in a predominantly cyclotron motion, they continue accumulating the phase during and after the extraction from the trap. Therefore, the detected phase will also depend on the ion extraction time and time of flight to the position detector. This may introduce additional phase uncertainty due to the axial position and energy spread of the ions.

A second example method of obtaining the ICR frequency information may involve MP-ICR via continuous quadrupole RF signal. In such a method, an ion packet may be initially prepared in a predominantly magnetron motion state. The ions may then undergo a continuous conversion of the magnetron motion to a cyclotron motion and then back to a magnetron motion by a quadrupole RF field.

Figure 6A:
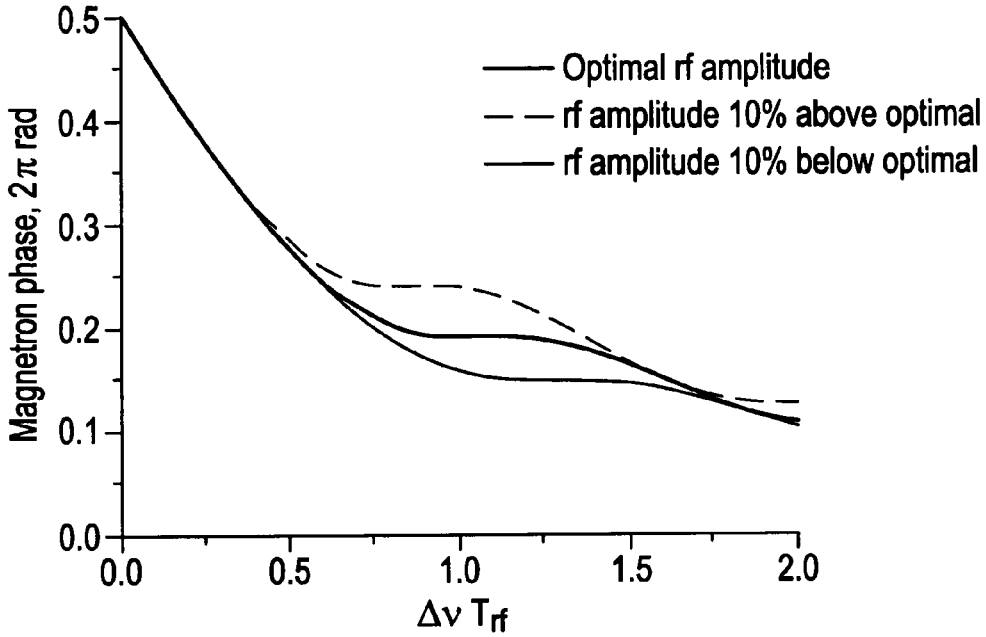
FIG. 6 is an illustration of the effects of converting a magnetron state of an ion motion to a cyclotron state and back to a magnetron state according to example embodiments.
Figure 6B:
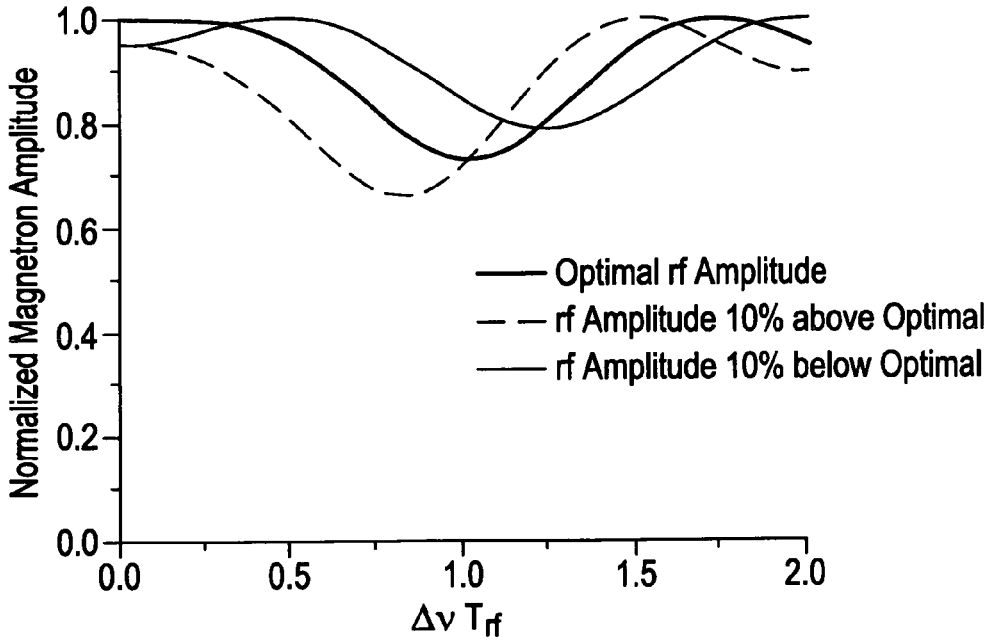

FIG. 6 is an illustration of the calculated effects of converting ion motion from a magnetron state to a cyclotron state and back to a magnetron state using a single frequency quadrupole radio frequency signal according to example embodiments. Referring to FIG. 6*a*, the magnetron phase is shown as a function of the detuning and frequency of the external RF quadrupole signal. Referring to FIG. 6*b*, the magnetron amplitude is shown as a function of the detuning and frequency of the external RF quadrupole signal. The graphs may be obtained by numerical integration of equations for the magnetron and cyclotron motion in a quadrupole RF field.

Alternatively, the ions may be initially manipulated to have a pure cyclotron motion followed by a conversion to a magnetron motion by an RF pulse. Unlike the above first method involving the accumulation period, the RF pulse is applied during most of the measurement time in the second method and not as a short pulse at the end of the cyclotron phase accumulation period as in the first method.

Referring to FIG. 6, the magnetron phase dependence on the RF amplitude may be practically non-existent for frequencies close to the resonant. The slope of the phase dependence may determine the resolving power for a given measurement time. Calculating this slope shows that the resolving power of the continuous quadrupole conversion method (second method) may be about half that of the free cyclotron motion phase accumulation method (first method) previously described above.

As described above, the resolving power of the MP-ICR method according to example embodiments may be greater than that of conventional phase insensitive methods (e.g., FT-ICR, TOF-ICR). However, the enhancement factor $2\pi/\alpha\phi$ may depend on the statistical spread $\Delta\phi_-$ of the magnetron phase values of the ions in the packet. Assuming that initially, the ion packet of radius r was excited to magnetron motion with radius $R_-$. A simple trigonometric estimate shows that in that case $$\Delta\phi_- \approx \frac{2r}{R_-}, \tag{16}$$

and the enhancement factor is $$C = \frac{2\pi}{\Delta\phi_-} = \frac{\pi R_-}{r}. \tag{17}$$

FIG. 7 is an illustration of the effect of ion packet size on the resolution of the MP-ICR method according to example embodiments. A mock up of the ion packets as registered by a detector are shown. The shaded contours indicate the different levels in the rate of the incoming particles (with boundaries at 1%, 10%, 50%, and 100% of a single mass peak value).

Figure 7A:
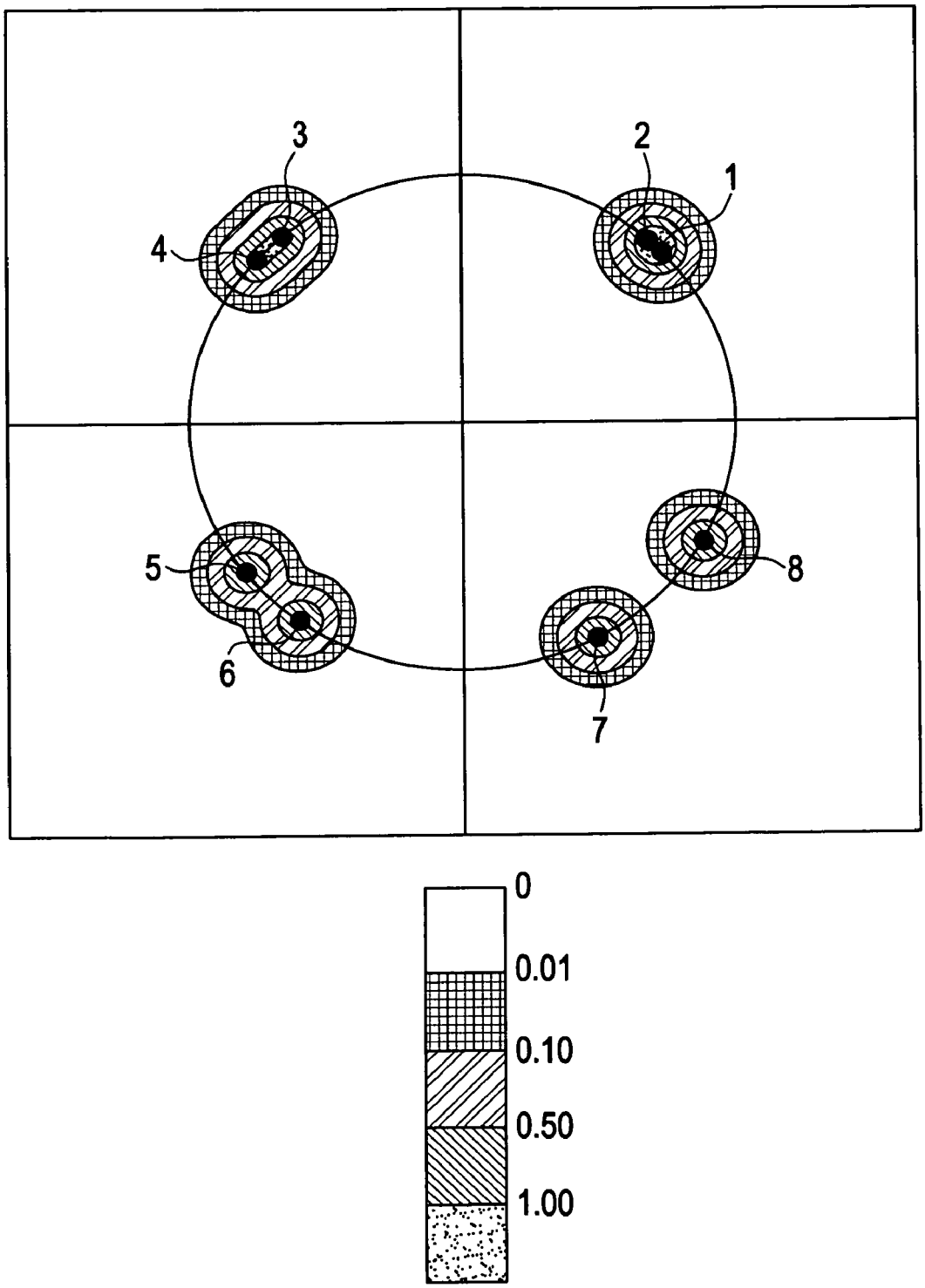
FIGS. 7*a*-7*c* are illustrations of the effect of ion packet size on the resolution of the magnetron phase ion cyclotron resonance (MP-ICR) method according to example embodiments.
Figure 7B:
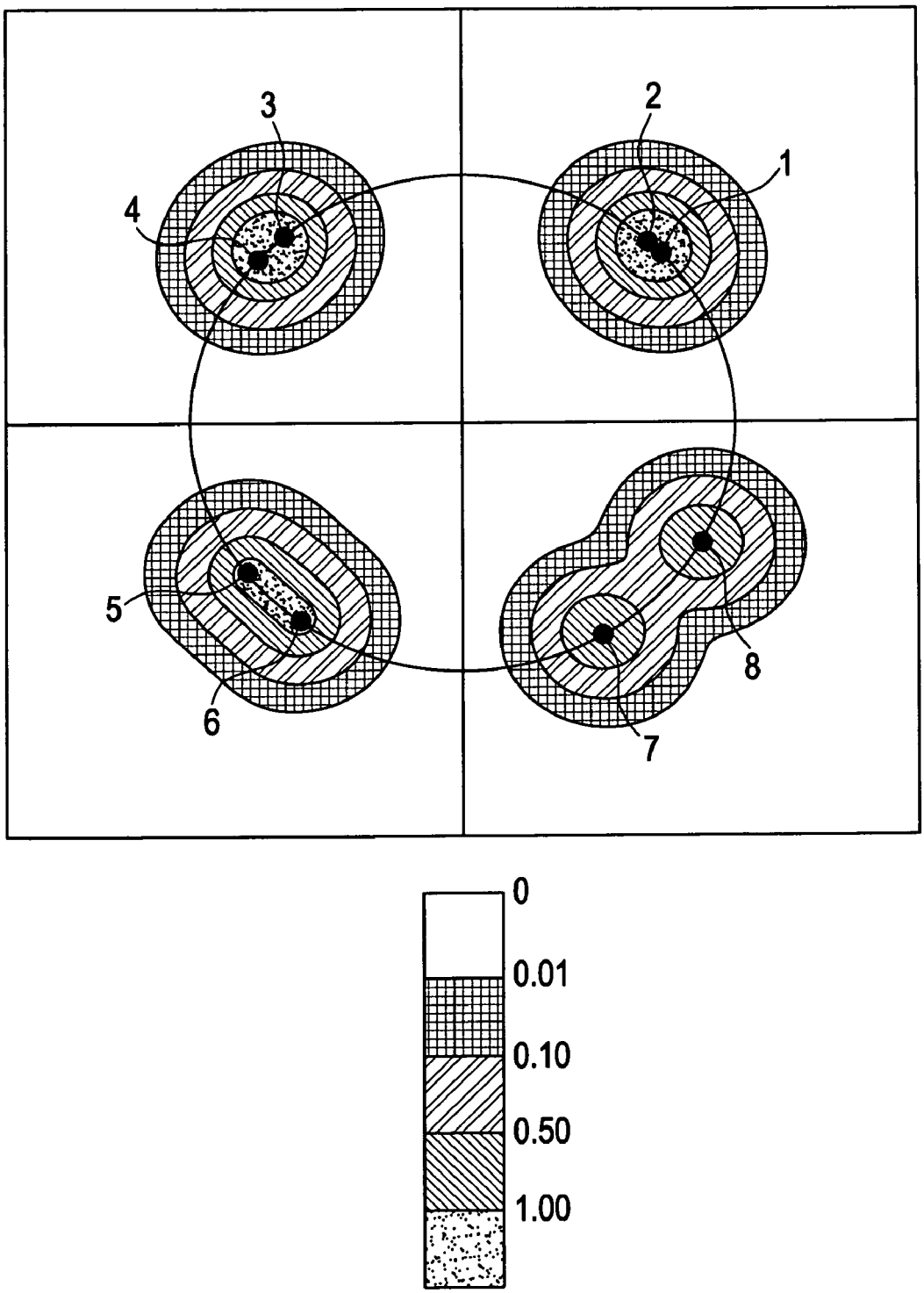

Referring to FIGS. 7*a-b*, the mass spectrum consists of eight distinct masses in approximately equal amounts. The final magnetron radius of all ion packet components is about the same and is represented by the circle centrally-positioned among the four quadrants. The center of each mass peak is indicated by a dot on the circle and the corresponding number. The mass difference between pairs 1-2, 3-4, 5-6, and 7-8 is such that the accumulated phase places each pair into four different quadrants of the detector. The mass difference within each pair is doubled from one pair to the next.

Figure 7C:
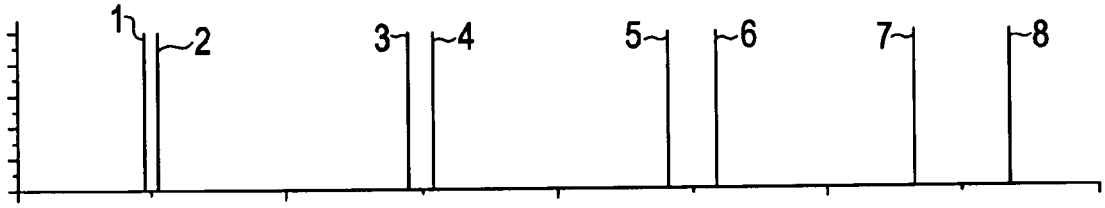

The main difference between the spectra shown in FIG. 7*a* and FIG. 7*b* is that the size (diameter) of the ion packet in FIG. 7*b* is about twice as large as the ion packet in FIG. 7*a*. Consequently, while the masses for pairs 5-6 and 7-8 may be resolved in FIG. 7*a*, only the masses for pair 7-8 may be resolved in FIG. 7*b*. Referring to FIG. 7*c*, the mass composition of the ion packet is shown. The position of the bar along the x axis may be proportional to the ICR frequency of the given mass component in the ion packet, and the height of the bar may be proportional to the quantity present in the ion packet.

If only the phase information of ion magnetron motion is utilized for mass analysis, then the bandwidth of the MP-ICR method may be limited to the value of the enhancement factor as given by equation 17, supra. However, the enhancement factor may not exceed the hundreds. In that case, the bandwidth of a single measurement cycle may be limited to about a hundred distinct masses. Some possible ways of extending the number of masses that may be covered by a single measurement are described below. For instance, if different mass ranges are manipulated to have different final magnetron motion amplitudes (e.g., by engineering the initial cyclotron excitation signal in the free phase accumulation MP-ICR method), then bandwidths on the order of $10^3$-$10^4$ distinct masses may be obtained in a single measurement cycle.

FIG. 8 is an illustration of magnetron radius manipulation according to example embodiments. By manipulating the final magnetron radius, bandwidth may be increased. The shaded contours indicate the different levels in the rate of the incoming particles (with boundaries at 1%, 10%, 50%, and 100% of a single mass peak value). The spectra may be engineered to fall within the first quadrant of the detector to demonstrate separation of the peaks in the radial direction without crowding the picture.

Figure 8A:
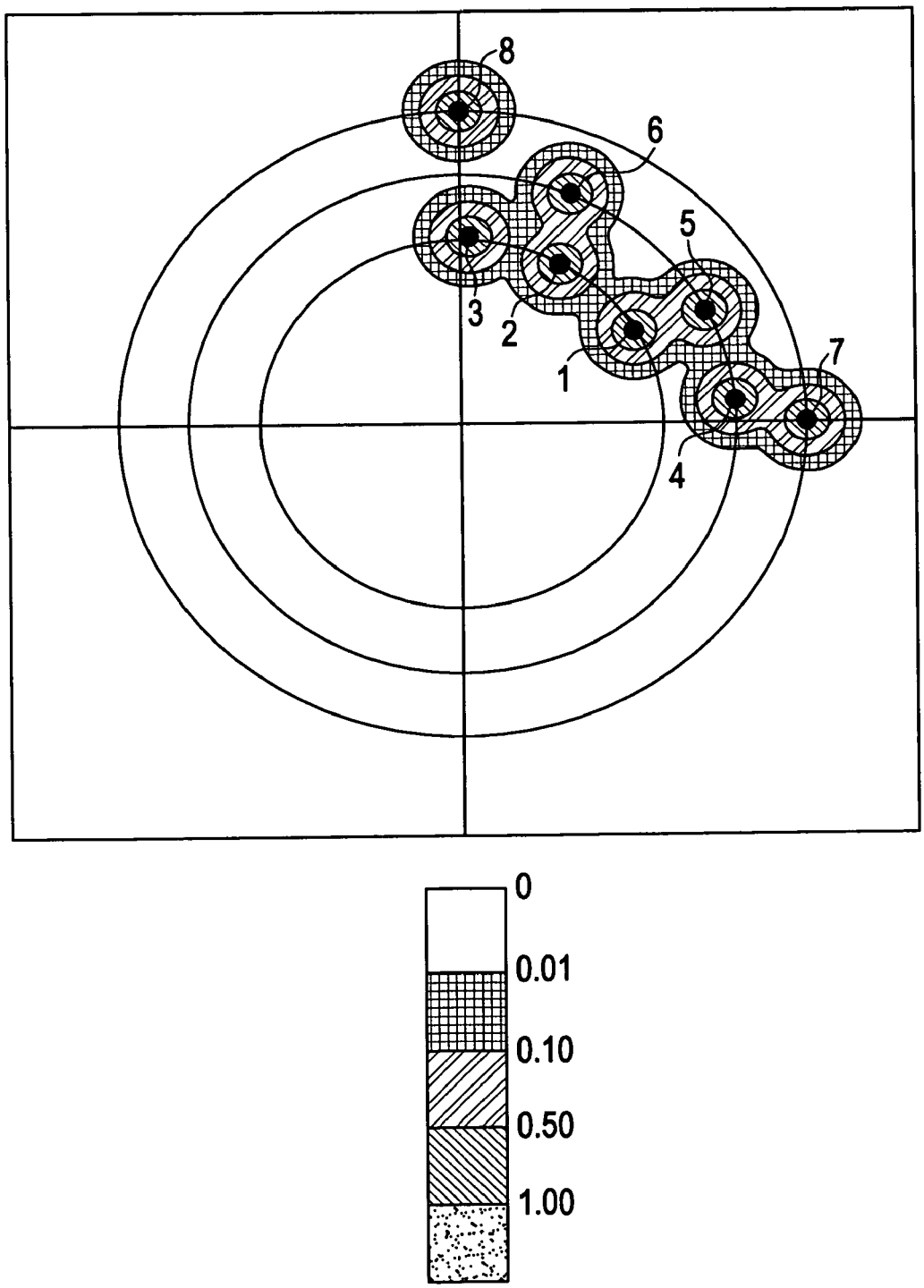
FIGS. 8*a*-8*d* are illustrations of magnetron radius manipulation according to example embodiments.
Figure 8B:
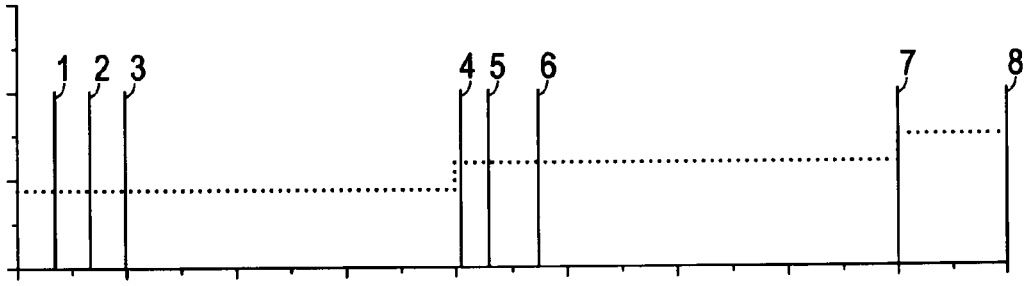

Referring to FIGS. 8*a-b*, the final magnetron radius may be increased in steps from one portion of the mass range to the next. As a result, the masses from different ranges may impact onto the detector along concentric circles of different radii, as shown in FIG. 8*a*. The final magnetron radii are represented by the three concentric circles centrally-positioned among the four quadrants. The center of each mass peak is indicated by a dot on one of the circles and the corresponding number.

FIG. 8*b* shows the mass composition of the ion packet corresponding to FIG. 8*a*. Referring to FIG. 8*b*, the position of the bar along the x axis may be proportional to the ICR frequency of the given mass component of the ion packet. Additionally, the height of the bar may be proportional to the quantity present in the ion packet. Furthermore, the spectrum of the cyclotron excitation needed for the different final magnetron radii is shown by a dotted line, which increases in steps for each increasing radii.

Figure 8C:
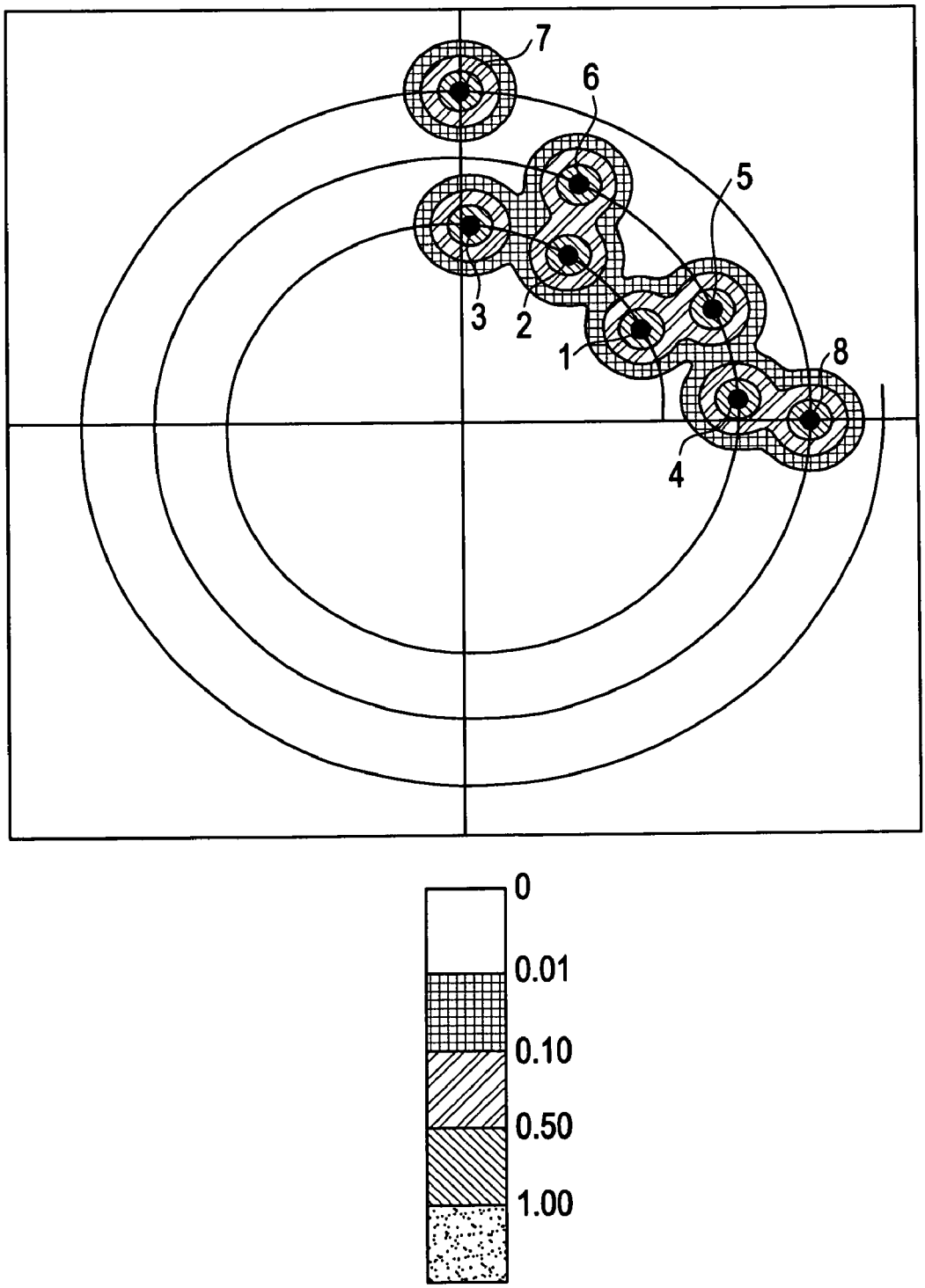
Figure 8D:
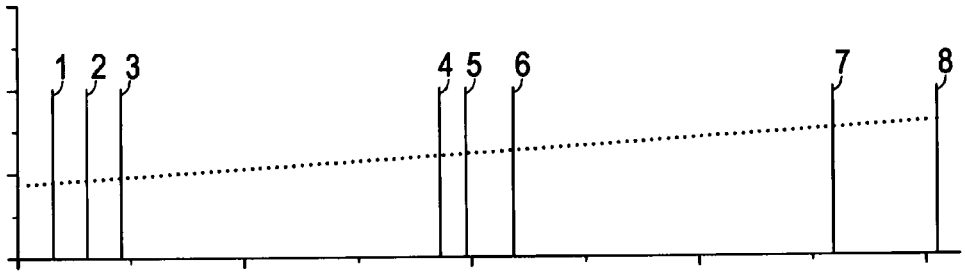

Similarly, FIGS. 8*c-d* depict the image spectrum and the composition of an ion packet wherein the final magnetron radii were manipulated to continuously increase along the spectrum. As a result, the centers of the mass peaks (shown as dots) fall onto a spiral, as shown in FIG. 8*c*. Referring to FIG. 8*d*, the spectrum of the cyclotron excitation needed for the different final magnetron radii is shown by a sloping dotted line, which gradually increases for each increasing radii.

Another technique for increasing the bandwidth of the MP-ICR method according to example embodiments may be to extract different mass ranges at different times. For example, a "staggered" extraction may be performed using axial excitation. With staggered extraction, the duration of the measurement cycle may need to be increased depending on the speed of the position sensitive detector. Additionally, magnetron radius manipulation, as described above, may be combined with staggered extraction.

FIG. 9 is an illustration of magnetron radius manipulation with staggered extraction according to example embodiments. By manipulating the final magnetron radius and using "staggered" extraction, the bandwidth may be extended. The shaded contours indicate different levels in the rate of the incoming particles (with boundaries at 1%, 10% 50%, and 100% of a single mass peak value). The spectra may be engineered to fall within the first quadrant of the detector to demonstrate the separation of the peaks in the radial direction without crowding the picture.

Figure 9A:
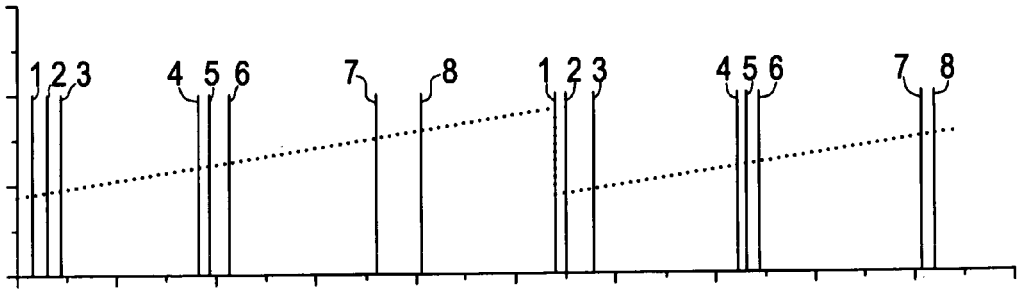
FIGS. 9*a*-9*f* are illustrations of magnetron radius manipulation with staggered extraction according to example embodiments.

FIG. 9*a* shows the composition of the ion packet which consists of 16 components in approximately equal quantities. The mass range may be divided into two groups, and the final magnetron radii of both groups may be manipulated to fall along identical spirals. The components of the two different groups are shown as bars 1-8 on the left side and bars 1-8 on the right side of the graph. The spectrum of the RF signal used to manipulate the final magnetron radii is shown as a dotted line.

Figure 9B:
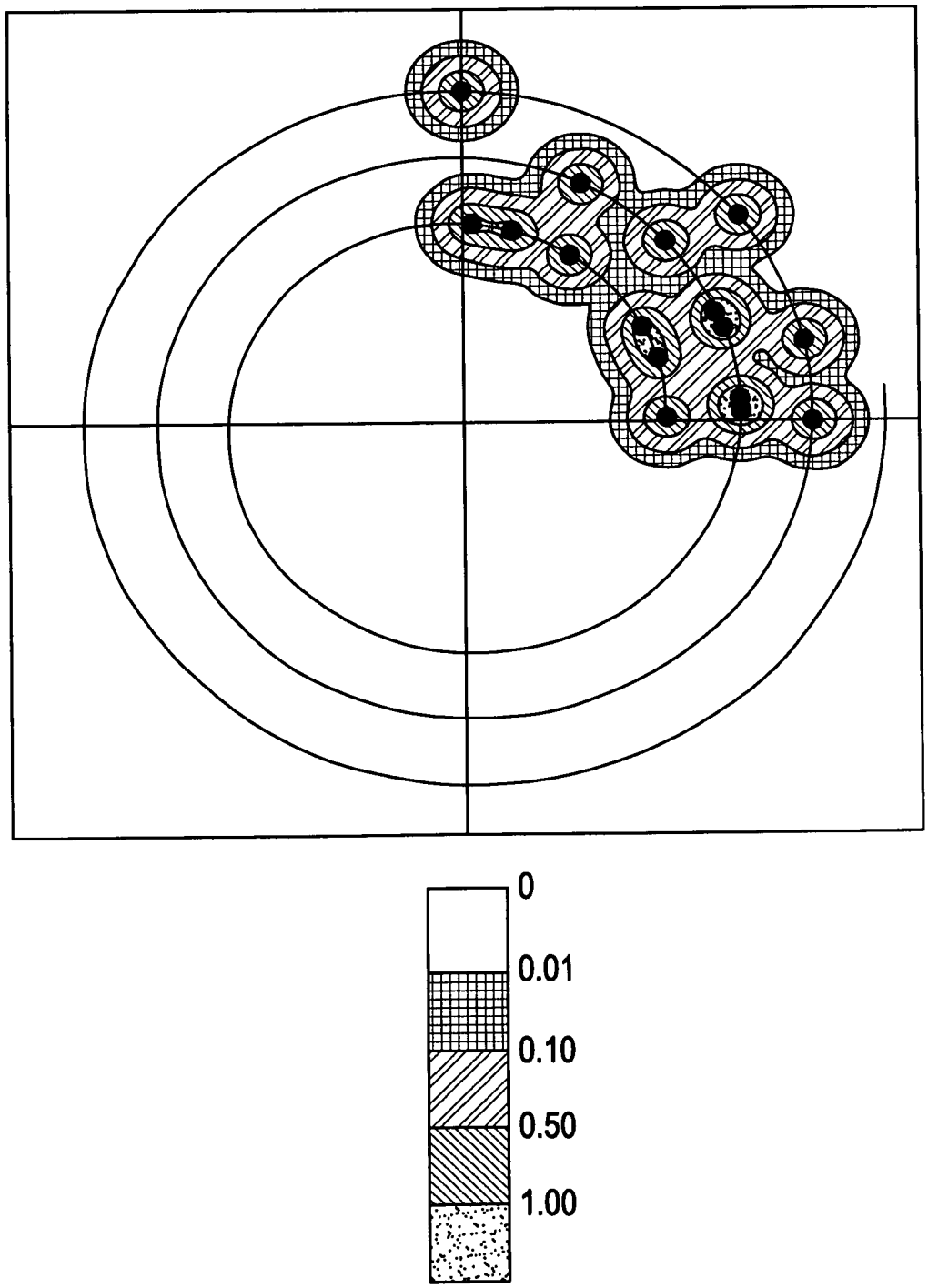

FIG. 9*b* shows the distribution of the ion packet in the ICR cell at the end of the phase accumulation. However, if all of the components are extracted at once, not all of the components may be clearly separated. Instead, the components of the two different groups may be extracted separately, and the distribution of their impact on the particle detector may be captured as two different distributions. The first group may be extracted by applying an axial RF excitation that excites and consequently expels the first group of packet components.

Figure 9C:
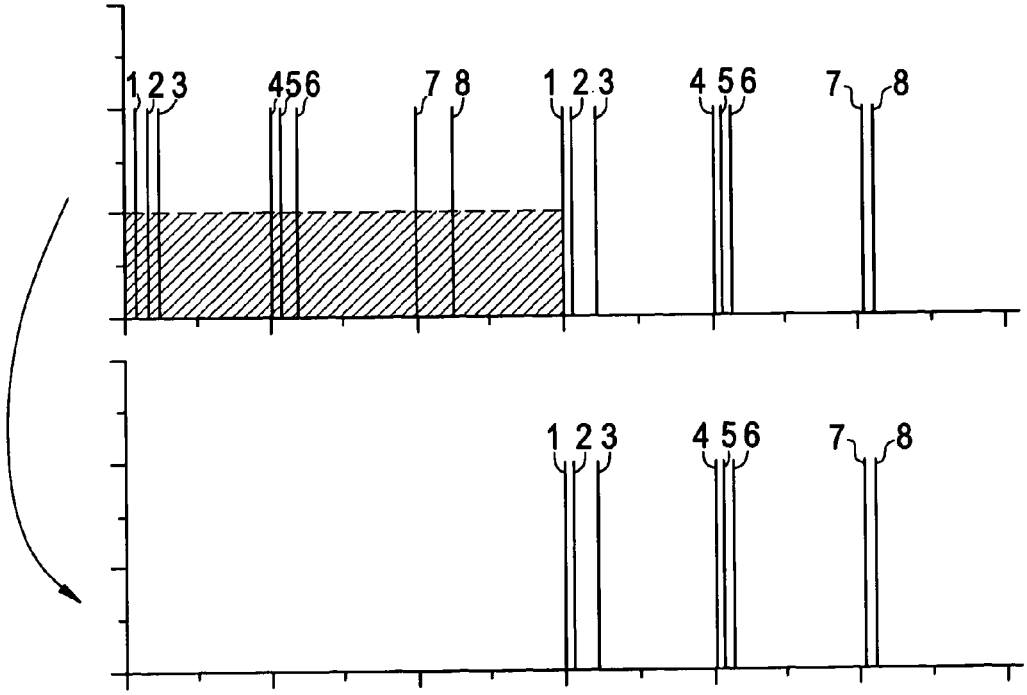
Figure 9D:
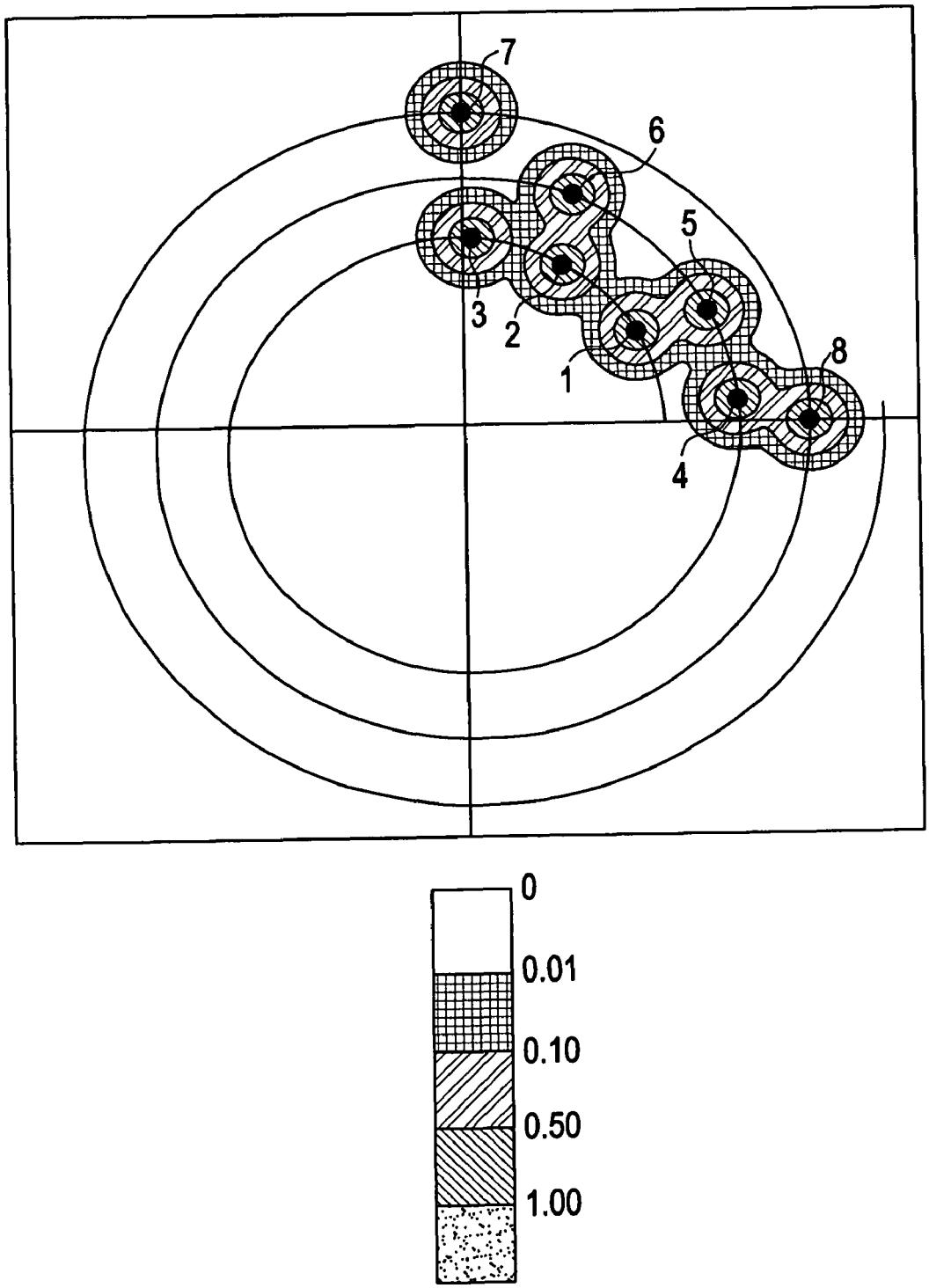
Figure 9E:
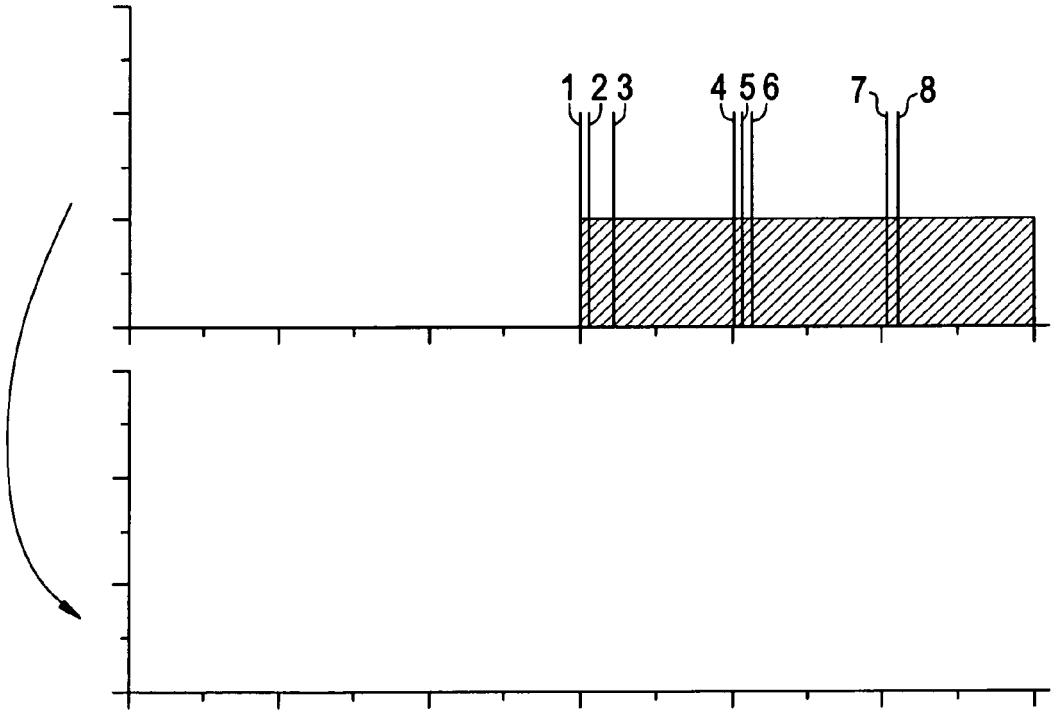
Figure 9F:
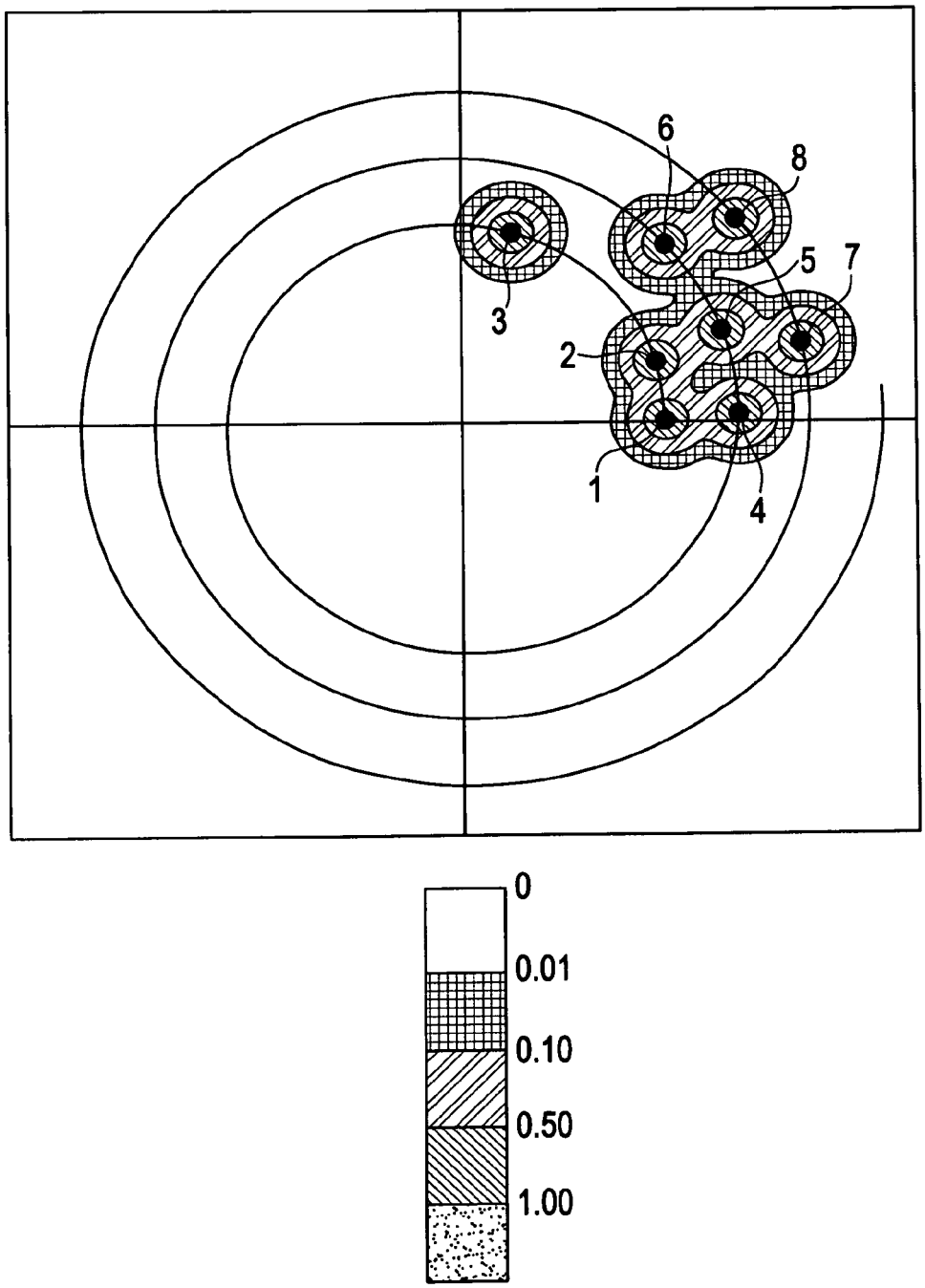

FIG. 9*c* shows the composition of the ion packet in the ICR cell and the spectrum of the applied axial RF signal as represented by the shaded region. An arrow indicates the composition of the packet after axial RF excitation of the first group. FIG. 9*d* shows the distribution of particles impacting the detector after the axial excitation of FIG. 9*c*. As shown in FIG. 9*d*, only the components of the first group are extracted and registered during this first stage of the extraction. Similarly, FIGS. 9*e*-*f* show the axial excitation and resulting impact distribution of the second group on the detector in the second stage of the extraction. The components of the ion packet may be separated into many such groups, thus further extending the dynamic range of a single measurement.

It should be understood that the method according to example embodiments does not prohibit also implementing FT-ICR (or another suitable ICR method) in the same measurement device. Rather, this combination would allow a user to choose between different detection methods within the same instrument.

Instruments that use a FT-ICR measurement method may be constructed around a superconducting solenoidal electromagnet that creates a relatively strong magnetic field. The relatively strong magnetic field is desirable, because it may produce faster cyclotron oscillations. Expression (9) shows how higher cyclotron frequencies may be needed to realize a relatively high resolution within a reasonable measurement time. Because the method according to example embodiments has increased resolving power, the accessible mass range of the superconducting solenoid based devices may be extended. Thus, the range of masses accessible with weaker magnetic fields may also be extended. The weaker magnetic fields may be produced with non-superconducting electromagnets and permanent magnets, which may be cheaper to manufacture and maintain.

The MP-ICR method of Penning trap mass spectrometry according to example embodiments utilizes external RF signals to manipulate ions such that their motion may be shifted between a magnetron motion and a cyclotron motion, with the ions ending up in a predominantly magnetron motion mode. The phase and amplitude of the resulting magnetron motion may be determined by expelling the ions along the magnetic field axis onto a position sensitive charged particle detector. The phase and amplitude information may then be obtained from the impact coordinates of various ions and used to determine their cyclotron frequencies. The phase sensitivity of the MP-ICR method according to example embodiments may allow for increased resolving power and may have an efficiency of about 50% or greater so as to attain close to a single particle sensitivity. Accordingly, the method according to example embodiments provides improvements in relatively high precision mass spectrometry, as well as advances in mass spectroscopy instrumentation.

While example embodiments have been disclosed herein, it should be understood that other variations may be possible. Such variations are not to be regarded as a departure from the spirit and scope of example embodiments of the present application, and all such modifications as would be obvious to one skilled in the art are intended to be included within the scope of the following claims.

The invention claimed is:

1. A method of mass spectroscopy, comprising:

injecting ions into a Penning trap;

storing the ions in the Penning trap for a period of time;

manipulating motions of the ions by applying one or more radio frequency signals during the period of time;

ejecting the ions from the Penning trap onto a position sensitive charged particle detector to determine phases and amplitudes of the motions; and determining ion cyclotron resonance frequencies of the ions based on the phases and amplitudes of the motions of the ejected ions.

2. The method of claim 1, wherein the ions are injected into the Penning trap on-axis.

3. The method of claim 1, wherein the ions are injected into the Penning trap off-axis.

4. The method of claim 1, wherein manipulating the motions includes using one or more quadrupole radio frequency signals to convert between cyclotron motions and magnetron motions of the ions.

5. The method of claim 1, wherein manipulating the motions includes using one or more dipole radio frequency signals to change amplitudes and phases of cyclotron motions of the ions.

6. The method of claim 1, wherein manipulating the motions includes using one or more dipole radio frequency signals to change amplitudes and phases of magnetron motions of the ions.

7. The method of claim 1, wherein manipulating the motions results in the ions undergoing magnetron motions prior to ejection.

8. The method of claim 1, wherein manipulating the motions results in the ions undergoing cyclotron motions prior to ejection.

9. The method of claim 1, wherein the ions have different mass ranges, and one or more radio frequency signals are used to achieve different motion radii for different mass ranges of the ions.

10. The method of claim 9, wherein the motion radii are increased in steps from one mass range to another mass range.

11. The method of claim 9, wherein the motion radii are gradually increased from one mass range to another mass range.

12. The method of claim 1, wherein the ions have different mass ranges, and ions of one mass range are ejected at a different time from ions of another mass range by using axial excitation.

13. The method of claim 1, wherein the position sensitive charged particle detector is a segmented detector.

14. The method of claim 1, wherein the position sensitive charged particle detector is a microchannel plate detector.

15. The method of claim 1, wherein one or more apertures are placed in front of the position sensitive charged particle detector so as to be in a path of the ejected ions traveling toward the position sensitive charged particle detector.

16. The method of claim 1, wherein the position sensitive charged particle detector is placed in an internal region inside a magnetic field of the Penning trap.

17. The method of claim 1, wherein the position sensitive charged particle detector is placed in an external region outside a magnetic field of the Penning trap.

18. The method of claim 1, wherein the position sensitive charged particle detector is placed in an intermediate region between an internal region inside a magnetic field of the Penning trap and an external region outside the magnetic field of the Penning trap.

19. A method of mass spectroscopy, comprising:

injecting ions into a Penning trap off-axis, the ions having cyclotron motions;

storing the ions in the Penning trap for a period of time;

ejecting the ions from the Penning trap onto a position sensitive charged particle detector to determine phases and amplitudes of the cyclotron motions; and determining ion cyclotron resonance frequencies of the ions based on the phases and amplitudes of the cyclotron motions of the ejected ions.

20. The method of claim 19, wherein the ions have different mass ranges, and ions of one mass range are ejected at a different time from ions of another mass range by using axial excitation.

21. The method of claim 19, wherein the position sensitive charged particle detector is a segmented detector.

22. The method of claim 19, wherein the position sensitive charged particle detector is a microchannel plate detector.

23. The method of claim 19, wherein one or more apertures are placed in front of the position sensitive charged particle detector so as to be in a path of the ejected ions traveling toward the position sensitive charged particle detector.

24. The method of claim 19, wherein the position sensitive charged particle detector is placed in an internal region inside a magnetic field of the Penning trap.

25. The method of claim 19, wherein the position sensitive charged particle detector is placed in an external region outside a magnetic field of the Penning trap.

26. The method of claim 19, wherein the position sensitive charged particle detector is placed in an intermediate region between an internal region inside a magnetic field of the Penning trap and an external region outside the magnetic field of the Penning trap.

* * * * *